US007096921B2

(12) United States Patent
Moore et al.

(10) Patent No.: US 7,096,921 B2
(45) Date of Patent: Aug. 29, 2006

(54) FUNCTIONALLY GRADED ALUMINA-BASED THIN FILM SYSTEMS

(75) Inventors: John J. Moore, Evergreen, CO (US); Dalong Zhong, Lakewood, CO (US)

(73) Assignee: Colorado School of Mines, Golden, CO (US)

( * ) Notice: Subject to any disclaimer, the term of this patent is extended or adjusted under 35 U.S.C. 154(b) by 0 days.

(21) Appl. No.: 11/136,613

(22) Filed: May 23, 2005

(65) Prior Publication Data

US 2005/0263261 A1 Dec. 1, 2005

Related U.S. Application Data

(60) Provisional application No. 60/573,432, filed on May 21, 2004.

(51) Int. Cl.
*B22C 3/00* (2006.01)
*B28B 7/34* (2006.01)

(52) U.S. Cl. ..... 164/113; 164/138; 164/312; 249/135; 427/405

(58) Field of Classification Search ..... 164/72, 164/113, 119, 138, 303–318; 249/135; 427/405
See application file for complete search history.

(56) References Cited

U.S. PATENT DOCUMENTS 5,223,350 A * 6/1993 Kobayashi et al. ..... 428/697
5,318,091 A * 6/1994 Pavoni et al. ..... 164/6
5,626,909 A * 5/1997 Iacovangelo ..... 427/250
5,789,071 A * 8/1998 Sproul et al. ..... 428/216
5,820,976 A * 10/1998 Kamo ..... 428/312.8
2004/0072038 A1* 4/2004 Henderer ..... 428/698

FOREIGN PATENT DOCUMENTS

JP 2-303637 * 12/1990

* cited by examiner

*Primary Examiner*—Kuang Y. Lin
(74) *Attorney, Agent, or Firm*—Sheridan Ross P.C.

(57) ABSTRACT

The present invention provides coating systems that minimize thermal and residual stresses to create a fatigue- and soldering-resistant coating for aluminum die casting dies. The coating systems include at least three layers. The outer layer is an alumina- or boro-carbide-based outer layer that has superior non-wettability characteristics with molten aluminum coupled with oxidation and wear resistance. A functionally-graded intermediate layer or "interlayer" enhances the erosive wear, toughness, and corrosion resistance of the die. A thin adhesion layer of reactive metal is used between the die substrate and the interlayer to increase adhesion of the coating system to the die surface.

30 Claims, 1 Drawing Sheet

FUNCTIONALLY GRADED ALUMINA-BASED THIN FILM SYSTEMS

CROSS-REFERENCE TO RELATED APPLICATIONS

This application claims priority to U.S. Provisional Patent Application Ser. No. 60/573,432, filed May 21, 2004 which is incorporated herein in its entirety by this reference.

GOVERNMENT INTEREST

This invention was made with Government support under grant No. DE-FC36-00ID13850 awarded by the Department of Energy. The Government has certain rights in this invention.

FIELD OF THE INVENTION

The invention resides in the field of coating systems for use in aluminum die-casting dies, and specifically, multi-layer, functionally graded coating architecture having a dense alumina-based coating.

BACKGROUND OF THE INVENTION

The aluminum die casting industry spends an enormous amount of money each year replacing dies due to premature failure. Premature die failures are a result of erosive wear, corrosion/oxidation, soldering, and thermal fatigue. The die casting industry could recognize significant savings by reducing the number of premature die failures, and thereby replacement costs, while reducing downtime and environmental waste. It has been estimated that die life may be increased by as much as 3 to 100 times depending on the process cycle and aluminum alloy used.

Several coating companies provide wear resistant coatings for specific parts of a die casting machine such as core pins. Other coating solutions have been described in the literature although not all have found commercial acceptance. For example, in U.S. Pat. No. 6,333,103, the Japanese group Ishii et al. describe the use of an alpha-alumina system for use in coating tools, dies and metal melt-contacting members. U.S. Pat. No. 5,972,495 to the same Japanese group teach the use of alpha-alumina as a good coating for increasing wear resistance for cutting tools. U.S. Pat. Nos. 5,702,808; 5,766,782 and 5,851,687 to Ljungberg teach the use of a CVD alpha-alumina as a wear resistant coating for use in chip forming machining. U.S. Pat. No. 5,705,263 to Leander et al. discloses the use of a CVD alumina coated cemented carbide body to improve wear resistance of cutting tool inserts. U.S. Pat. No. 5,137,774 to Ruppi describes the use of a multi-purpose alumina system as a hard wear-resistant coating for milling and cutting both cast irons and steels. This coating incorporates the combined properties of kappa-alumina and alpha-alumina in the coating. U.S. Pat. No. 5,071,696 to Chatfield et al. discloses the use of CVD alumina in contact with TiC for increasing wear resistance in cutting inserts. U.S. Pat. No. 3,977,061 to the Swedish group Lindstrom et al. discloses the use of ceramic oxides to increase wear and toughness in sintered hard metal bodies (cutting inserts). U.S. Pat. No. 3,837,896 to the same Swedish group discloses using metallic carbides or metallic nitrides as a coating to improve wear resistance.

Despite these proposed means of strengthening die casting coatings, there is still a need for die casting equipment coatings having improved microstructure of the alumina to form a coating that displays good non-wettability with aluminum coupled with oxidation and wear resistance.

SUMMARY OF THE INVENTION

The present invention provides metallic coatings for tools and dies, each coating having a graded aluminum layer. In one embodiment, the invention provides a coating for an aluminum die casting die including an outer layer; an adhesion layer that makes contact with a surface of an aluminum die casting die and an interlayer that has a graded metallic component in between the outer layer and the adhesion layer. The outer layer may include an aluminum oxide such as $Al_2O_3$ or a boro-carbide such as titanium boro-carbide (Ti—B—C). The outer layer may also contain other oxides, such as titanium oxide or chromium oxide. In one preferred embodiment, the outer layer contains $Al_2O_3$—$TiO_2$—$Cr_2O_3$. The outer layer typically has a thickness of between about 1 micrometer and about 4 micrometers.

The preferred adhesion layer is a reactive metal such as titanium, chromium, tungsten or combinations of these metals. The adhesion layer typically has a thickness of between about 40 nanometers and about 300 nanometers.

The layer between the adhesion layer and the outer layer or "interlayer" contains a graded concentration of aluminum in a metal nitride such as CrN or TiN, TiAlN, CrAlN, TiCrN or TiCrAlN. The interlayer contains an increasing concentration of aluminum in the layer beginning at the surface of the adhesion layer and increasing in the concentration of aluminum to the interface between the interlayer and the outer layer. Typically the metal nitride contains no or low aluminum at the surface of the adhesion layer and increases to a concentration of between about 50% and about 60% aluminum at the interface with the outer layer. The concentration gradient of aluminum in the graded interlayer may be either a power law function or a sinusoidal function. The thickness of the interlayer is typically between about 2 micrometers and about 5 micrometers.

The surface of the aluminum die casting die may be treated by plasma nitriding, ferritic nitrocarburizing, or implantation of metals such as titanium and/or chromium.

In another embodiment, the invention provides an aluminum die casting die coated with the three part coating system described above.

In another embodiment, the invention provides an aluminum die casting die having a surface coating containing aluminum oxide and/or a boro-carbide. This coating may also contain $Al_2O_3$, $TiO_2$, and $Cr_2O_3$.

DETAILED DESCRIPTION OF THE INVENTION

Figure 1:
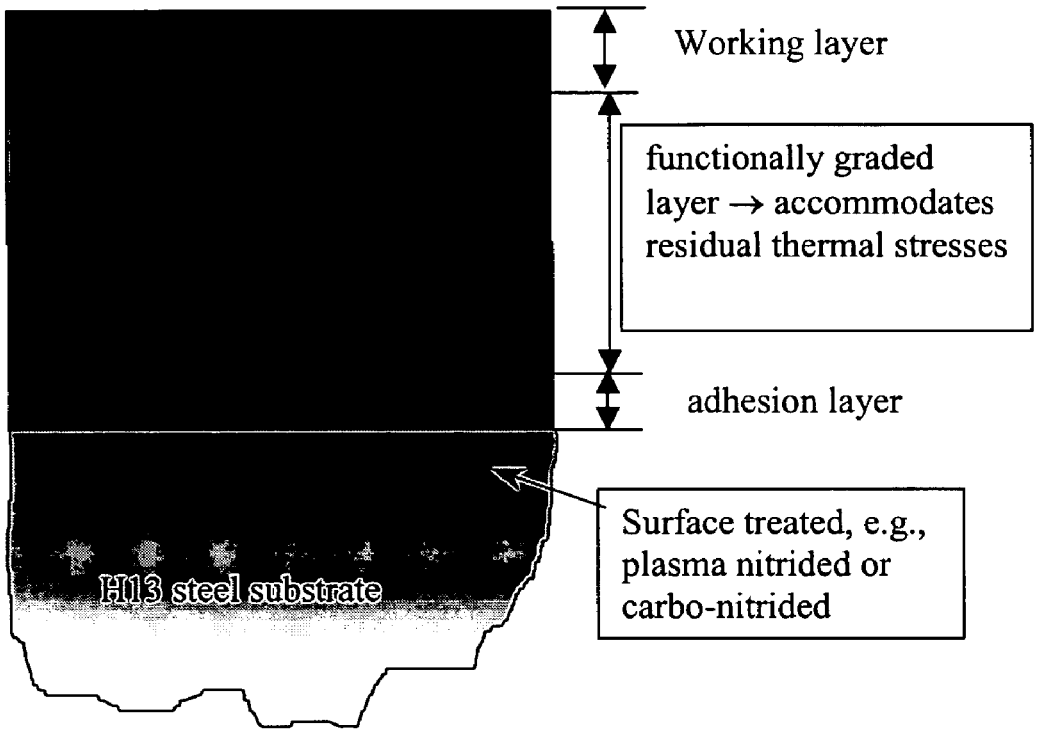
FIG. 1 is a schematic representation of one embodiment of the multilayer alumina-based architecture of the present invention.

Alumina has proven to be an exceptional surface layer for non-wettability with aluminum. The non-wetting property minimizes soldering of the molten aluminum to the die surface. Soldering is a major problem in aluminum pressure die casting that results in premature die failure. This invention provides alumina-based coatings for aluminum die casting dies with mechanical properties optimally tailored to the die casting process. These coatings increase the number of useful cycles of these dies before failure.

The coating systems of the present invention minimize thermal and residual stresses to create a fatigue-resistant coating. The outer layer provides non-wettability with molten aluminum coupled with oxidation and wear resistance. Enhanced mechanical properties of the coatings are provided by titanium-alloy graded aluminum intermediate layers that improve erosive wear, toughness, and corrosion due to the die casting process.

One embodiment of the present invention provides a method of making the coatings of the present invention by a pulsed DC PVD (unbalanced magnetron sputtering) source to alter, control and improve the microstructure of the alumina, improving the coating properties. In another embodiment of the present invention, a computational approach using finite element modeling (FEM) is provided to determine an optimum metal nitride to metal aluminum nitride functionally graded interlayer.

In this embodiment, a systematic approach using finite element modeling (FEM) combined with wettability tests is used to determine an optimal coating architecture. This architecture reduces the failure mechanisms leading to premature failure including soldering, corrosion/oxidation, erosion and heat checking. Wettability tests confirm that an alumina-based outer layer gives the best performance while the FEM confirms that a TiAlN intermediate layer accommodates thermal and residual stresses in the system.

The multi-layer, functionally-graded coatings of the present invention may have a dense alumina-based or boro-carbide-based coating produced by closed field unbalanced magnetron sputtering with a pulsed source as the outer layer. The outer layer provides non-wettability with molten aluminum, coupled with oxidation and wear resistance. A graded aluminum interlayer provides additional enhancements to the mechanical properties of the system and facilitates the accommodation of the thermally-induced residual stresses created from the temperature-pressure regime of the shot cycles routinely encountered in aluminum die casting. A thin adhesion layer is used as the interface between the graded interlayer and the surface of the die substrate. The coating systems of the present invention, including all of the individual layers, are less than about 10 micrometers thick. Preferably, the thickness of the system is between about 3 micrometers and about 7 micrometers.

Referring to FIG. 1, the aluminum die casting coatings of the present invention include a working or outer layer that interfaces with the molten aluminum and provides the non-wettability characteristics of these coatings. This outer layer may be an aluminum oxide or a metal boro-carbide. Due to this limited wettability, the outer layer shows exceptional resistance to oxidation and improved wear resistance. The outer layer may also include other oxides or compound oxides with $Al_2O_3$ such as oxides of titanium and chromium as binary or ternary oxide compounds, including, for example, $Al_2O_3$—$TiO_2$—$Cr_2O_3$. Preferably, this layer has a thickness of between about 1 micrometers and 4 micrometers. More preferably, the thickness of this outer layer is between about 2 micrometers and 3 micrometers.

The intermediate layer or interlayer is provided between the outer layer and the adhesion layer. This interlayer is a graded interlayer that starts with a metal nitride at the surface of the adhesion layer and increases in aluminum content to produce a metal-Al—N composition at the aluminum oxide outer layer. The thickness of this interlayer is preferably between about 2 micrometers and about 5 micrometers. The metal nitrides may be titanium or chromium nitride. These metal nitrides are functionally "graded" meaning there is a grading in the aluminum content of the composition from, for example, equiatomic TiN up to Ti—Al—N in which the aluminum content is gradually increased from about zero in the TiN found at the interface with the adhesion layer to between about 50% and about 60% at the interface with the outer layer.

The intermediate layer may include other nitrides and/or compound nitrides. For example, the intermediate layer may be a graded CrN intermediate layer containing a progressively greater amount of aluminum as the intermediate layer approaches the interface with the aluminum oxide outer layer. This interlayer is formed by depositing CrN on the adhesion layer, and grading this layer with an increasing aluminum concentration, terminating in a Cr—Al—N composition at the interface with the outer layer. This intermediate layer is represented as a "CrN—CrAlN" interlayer as an alternative to the TiN—TiAlN interlayer described above.

The intermediate layer may contain any combination of these nitrides. For example, the intermediate layer may contain both TiN and CrN with a graded concentration of aluminum therein. The aluminum concentration gradient in any of these intermediate layers can be either a power law function or a sinusoidal function.

This intermediate layer expands and contracts under the pressure and temperature extremes experienced in the aluminum die casting processes, greatly increasing the overall resistance of the coatings of the present invention to thermal stress. Closed field unbalanced magnetron sputtering (CFUBMS) is the physical vapor deposition technique employed in the deposition of this graded interlayer. The closed field unbalanced magnetron sputtering of the complete coating system (e.g., adhesion layer-graded aluminum nitride interlayer-outer layer) is deposited using pulsed plasma power to the magnetrons, although pulsed substrate biasing can also be used. Pulsed plasma is preferably used to improve the microstructures and properties of these coatings. The pulsing of the power can be conducted using a wide range of duty cycles (frequency of pulsing and times at cathode and anode voltages).

The adhesion layer of the present invention resides between the surface of the die and the graded interlayer. This layer is preferably composed of reactive metals such as titanium, chromium, tungsten or combinations thereof. Preferably, the adhesion layer is titanium. The adhesion layer has a thickness between about 40 nanometers and about 300 nanometers. More preferably, the thickness of adhesion layer is between about 50 nanometers and about 100 nanometers.

The surface of the die is preferably treated prior to applying the coating system. This treatment may include plasma nitriding, or ferritic nitrocarburizing, or implantation with elements such as titanium or chromium.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiment described hereinabove is further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An aluminum die casting die comprising a coating comprising:

a. an outer layer;

b. an adhesion layer that makes contact with a surface of an aluminum die casting die; and, c. an interlayer comprising a graded concentration of aluminum in a metal nitride between the outer layer and the adhesion layer.

2. The die of claim 1, wherein the outer layer is an aluminum oxide.

3. The die of claim 2, wherein the aluminum oxide is $Al_2O_3$.

4. The die of claim 1, wherein the outer layer comprises boro-carbide.

5. The die of claim 4, wherein the boro-carbide is titanium boro-carbide (Ti—B—C).

6. The die of claim 1, wherein the outer layer comprises aluminum oxide, and at least one of titanium oxide and chromium oxide.

7. The die of claim 1, wherein the outer layer comprises $Al_2O_3$—$TiO_2$—$Cr_2O_3$.

8. The die of claim 1, wherein the outer layer has a thickness of between about 1 micrometer and about 4 micrometers.

9. The die of claim 1, wherein the adhesion layer comprises a reactive metal.

10. The die of claim 9, wherein the reactive metal is selected from the group consisting of titanium, chromium, tungsten and combinations thereof.

11. The die of claim 1, wherein the adhesion layer has a thickness of between about 40 nanometers and about 300 nanometers.

12. The die of claim 1, wherein the metal nitride comprises at least one of CrN and TiN.

13. The die of claim 1, wherein the metal nitride comprises at least one of TiN, TiAlN, CrN, CrAlN, TiCrN and TiCrAlN.

14. The die of claim 1, wherein the graded interlayer comprises TiN at the surface of the adhesion layer with an increasing concentration of aluminum in the layer to a TiAlN alloy having between about 50% and about 60% aluminum at the interface of the graded interlayer with the outer layer.

15. The die of claim 1, wherein the graded interlayer comprises CrN at the surface of the adhesion layer with an increasing concentration of aluminum in the layer to a CrAlN alloy having between about 50% and about 60% aluminum at the interface of the graded interlayer with the outer layer.

16. The die of claim 1, wherein the graded interlayer comprises TiCrN at the surface of the adhesion layer with an increasing concentration of aluminum in the layer to a TiCrAlN alloy having between about 50% and about 60% aluminum at the interface of the graded interlayer with the outer layer.

17. The die of claim 1, wherein a concentration gradient of aluminum in the graded interlayer is at least one of a power law function and a sinusoidal function.

18. The die of claim 1, wherein the graded interlayer has a thickness of between about 2 micrometers and about 5 micrometers.

19. The die of claim 1, wherein the surface of the aluminum die casting die is exposed to a treatment selected from the group consisting of plasma nitriding, ferritic nitrocarburizing and implantation of at least one of titanium and chromium.

20. An aluminum die casting die comprising a coating comprising:

a. an outer layer comprising $Al_2O_3$;

b. a titanium adhesion layer that makes contact with a surface of an aluminum die casting die; and, c. an interlayer comprising titanium nitride (Ti—N) incorporating a graded concentration of aluminum up to about 50 atomic % of aluminum in the Ti—N, between the outer layer and the adhesion layer.

21. An aluminum die casting die comprising a coating comprising:

a. an outer layer comprising $Al_2O_3$;

b. a chromium adhesion layer that makes contact with a surface of an aluminum die casting die; and, c. an interlayer comprising chromium nitride (Cr—N) incorporating a graded concentration of aluminum up to about 50 atomic % of aluminum in the Cr—N, between the outer layer and the adhesion layer.

22. A method of coating an aluminum die casting die comprising:

applying a coating to an aluminum die casting die, said coating comprising:

a. an outer layer;

b. an adhesion layer that makes contact with a surface of the aluminum die casting die; and, c. an interlayer comprising a graded concentration of aluminum in a metal nitride between the outer layer and the adhesion layer.

23. The method of claim 22, wherein the outer layer comprises at least one of an aluminum oxide and a boro-carbide.

24. The method of claim 22, wherein the adhesion layer comprises a reactive metal selected from the group consisting of titanium, chromium, tungsten and combinations thereof.

25. The method of claim 22, wherein the metal nitride comprises at least one of CrN and TiN.

26. The method of claim 22, wherein the metal nitride comprises at least one of TiN, TiAlN, CrN, CrAlN, TiCrN and TiCrAlN.

27. The method of claim 22, wherein the graded interlayer comprises TiN at the surface of the adhesion layer with an increasing concentration of aluminum in the layer to a TiAlN alloy having between about 50% and about 60% aluminum at an interface of the graded interlayer with the outer layer.

28. The method of claim 22, wherein the graded interlayer comprises CrN at the surface of the adhesion layer with an increasing concentration of aluminum in the layer to a CrAlN alloy having between about 50% and about 60% aluminum at an interface of the graded interlayer with the outer layer.

29. The method of claim 22, wherein the graded interlayer comprises TiCrN at the surface of the adhesion layer with an increasing concentration of aluminum in the layer to a TiCrAlN alloy having between about 50% and about 60% aluminum at an interface of the graded interlayer with the outer layer.

30. A method of applying a coating to an aluminum die casting die comprising:

applying an adhesion layer to a surface of an aluminum die casting die;

applying an interlayer to the adhesion layer, said adhesion layer comprising a graded concentration of aluminum in a metal nitride; and, applying an outer layer to the interlayer.

* * * * *